US010100577B2

(12) United States Patent
Green

(10) Patent No.: US 10,100,577 B2
(45) **Date of Patent: *Oct. 16, 2018**

(54) APPARATUS PROVIDING SINGLE SUPPORT TO AN EXTENSION LADDER ENABLING LADDER USE ON LEVEL AND NON-LEVEL SURFACES

(71) Applicant: Scott E. Green, Dansville, NY (US)

(72) Inventor: Scott E. Green, Dansville, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/745,441

(22) Filed: Jun. 21, 2015

(65) Prior Publication Data

US 2015/0292264 A1 Oct. 15, 2015

Related U.S. Application Data

(63) Continuation of application No. 13/065,910, filed on Apr. 1, 2011, now Pat. No. 9,068,395.

(51) Int. Cl.

| | |
|---|---|
| ***E06C 7/42*** | (2006.01) |
| ***E06C 7/44*** | (2006.01) |
| ***E06C 7/50*** | (2006.01) |
| *E06C 7/18* | (2006.01) |

(52) U.S. Cl.

CPC ..... *E06C 7/44* (2013.01); *E06C 7/50* (2013.01); *E06C 7/188* (2013.01); *E06C 7/42* (2013.01)

(58) Field of Classification Search

CPC ... E06C 7/44; E06C 7/42; E06C 7/423; E06C 7/46; E06C 7/188; E06C 7/00; E06C 7/16; E06C 7/50

USPC ..... 182/107–109, 111, 200, 201, 203, 120, 182/121, 90, 92

See application file for complete search history.

(56) References Cited

U.S. PATENT DOCUMENTS

| | | | | |
|---|---|---|---|---|
| 440,185 | A * | 11/1890 | Myers | E06C 1/39 182/104 |
| 973,509 | A * | 10/1910 | Ison | E06C 7/44 182/200 |
| 1,576,695 | A | 3/1926 | Weber | |
| 2,203,114 | A | 6/1940 | Uecker et al. | |

(Continued)

OTHER PUBLICATIONS

Federal Specification RP-L-91D, Ladder, Straight, Extension and Trestle, Sections 3.1.8.3-3.2.7, 1970.

(Continued)

*Primary Examiner* — Daniel P Cahn

(74) *Attorney, Agent, or Firm* — Kenneth J. LuKacher Law Group; Kenneth J. LuKacher

(57) ABSTRACT

An apparatus attachable to an extension ladder is provided having a single leg extendable in a direction perpendicular and adjacent to the two lowest rungs of an extension ladder, a channel bar sized to receive a substantial length of a lowest rung of the ladder, and a hook for latching onto a next to lowest rung of the ladder. A foot pivotally mounted to the leg at one end thereof supports the leg onto or at least partially into a level or non-level surface. A step member extends from the leg at an angle. When the ladder is extended upwards by a user, a removable arm member is received through a holder of the leg to lie against a user's leg to provide stability and prevent spinning. The apparatus when attached to the lowest two rungs elevates the ladder to be non-contact with the level or non-level surface.

9 Claims, 8 Drawing Sheets

(56) References Cited

U.S. PATENT DOCUMENTS

| | | | | | |
|---|---|---|---|---|---|
| 2,249,304 | A * | 7/1941 | Wilson | E06C 7/44 | 182/201 |
| 2,289,499 | A | 7/1942 | Husted | | |
| 2,419,065 | A * | 4/1947 | Fowler | E06C 7/42 | 182/107 |
| 2,567,989 | A | 9/1951 | Cheek | | |
| 2,584,015 | A | 1/1952 | Hawes | | |
| 2,802,702 | A * | 8/1957 | Rose | E06C 7/16 | 182/121 |
| 3,428,147 | A * | 2/1969 | Gordon | E06C 7/44 | 182/204 |
| 3,454,132 | A | 7/1969 | Platino et al. | | |
| 3,708,080 | A | 1/1973 | Schlei | | |
| 3,933,222 | A | 1/1976 | Craig, Jr. | | |
| 4,730,697 | A * | 3/1988 | Campbell | E06C 7/16 | 182/121 |
| 4,846,305 | A * | 7/1989 | Kupfert | E06C 7/42 | 182/109 |
| 4,896,745 | A | 1/1990 | Warnelov | | |
| 4,984,655 | A * | 1/1991 | Scherer | E06C 7/44 | 182/111 |
| 5,027,923 | A * | 7/1991 | Derome | E06C 7/44 | 182/111 |
| 5,121,813 | A | 6/1992 | Funston | | |
| 5,174,412 | A * | 12/1992 | Vega | E06C 7/44 | 182/204 |
| 5,232,067 | A * | 8/1993 | Griffith | E06C 7/44 | 182/201 |
| 5,265,699 | A * | 11/1993 | Phoumisavanh | E06C 7/44 | 182/201 |
| 5,423,397 | A * | 6/1995 | Boughner | E06C 7/44 | 182/107 |
| 5,507,364 | A * | 4/1996 | Spevak | E06C 7/44 | 182/200 |
| 5,553,963 | A * | 9/1996 | Hoy | E06C 7/44 | 182/108 |
| 5,590,739 | A * | 1/1997 | High | E06C 1/12 | 182/169 |
| 5,609,222 | A * | 3/1997 | Horbacewicz | E06C 7/44 | 182/109 |
| 5,944,142 | A | 8/1999 | Milner | | |
| 6,206,139 | B1 | 3/2001 | Bogart, Jr. | | |
| 6,378,656 | B1 | 4/2002 | Kohler | | |
| 6,435,306 | B2 | 8/2002 | Stoneburg | | |
| 6,640,931 | B2 | 11/2003 | Palmer et al. | | |
| 6,948,591 | B2 * | 9/2005 | Scott | E06C 7/44 | 182/201 |
| 7,185,739 | B1 | 3/2007 | Blehm | | |
| 8,047,331 | B2 | 11/2011 | Spicer | | |
| 2003/0034207 | A1 * | 2/2003 | Palmer | E06C 7/44 | 182/201 |
| 2004/0216955 | A1 | 11/2004 | Unger | | |
| 2007/0246301 | A1 * | 10/2007 | Shaffer | E06C 7/44 | 182/201 |
| 2007/0284189 | A1 * | 12/2007 | Chady | E06C 7/46 | 182/107 |
| 2007/0284190 | A1 * | 12/2007 | Chady | E06C 7/46 | 182/107 |
| 2007/0289812 | A1 * | 12/2007 | Feemster | E06C 7/46 | 182/107 |
| 2009/0200111 | A1 * | 8/2009 | Spicer | E06C 5/02 | 182/127 |
| 2011/0168492 | A1 | 7/2011 | Johnson | | |
| 2011/0226551 | A1 * | 9/2011 | Iverson | E06C 7/44 | 182/107 |
| 2012/0175188 | A1 * | 7/2012 | Xu | E06C 7/44 | 182/107 |
| 2015/0047924 | A1 * | 2/2015 | Graham, Sr. | E06C 7/188 | 182/107 |
| 2016/0201392 | A1 * | 7/2016 | Graham, Sr. | E06C 7/48 | 182/107 |

OTHER PUBLICATIONS

Federal Specification A-A-2278, Leveling Device, Ladder, 1985.
Federal Specification, RR-S-1862, Shoes, Safety, Ladder and Leveling Devices, Ladder, 1975.
OSHA Regulations, Section 1926.451, printed Dec. 30, 2009.

* cited by examiner

APPARATUS PROVIDING SINGLE SUPPORT TO AN EXTENSION LADDER ENABLING LADDER USE ON LEVEL AND NON-LEVEL SURFACES

This application is a continuation of U.S. patent application Ser. No. 13/065,910, filed Apr. 1, 2011, now U.S. Pat. No. 9,068,395, which is herein incorporated by reference.

FIELD OF THE INVENTION

The present invention relates to an apparatus (attachment and method) providing a single support to an extension ladder enabling the ladder to be used on level and non-level surfaces, and particularly to, an apparatus attachable to the bottom two rungs of an extension ladder for supporting the entire ladder on a single leg over level and non-level surfaces. The apparatus is useful for adapting an extension ladder for use on non-level surfaces, which could not support the two legs of the extension ladder to enable safe climbing upon the ladder, and which can also be used on level surface without modification of the apparatus attached to the ladder.

BACKGROUND ON THE INVENTION

An extension ladder has an upper and lower ladder portion which slide with respect to each other to adjust the height of the ladder. Each portion has two long parallel structural members, sides, or legs, which are coupled by equally spaced parallel rungs. Along the bottom of the two legs of the lower ladder portion are often swivel feet which pivot as needed such that the ladder may rest at an angle against a structure, such as tilted against the exterior of a home, building, or part thereof.

Typically, the upper ladder portion is extended with respect to the lower ladder portion by a user pulling on a rope attached near the bottom of the upper ladder portion which is fed through a pulley attached near the top of the lower ladder portion. The extension of the ladder typically occurs with the top of the ladder extending in the air and not leaning on any surface which could hinder sliding of the upper ladder portion with respect to the lower ladder portion. When the top of the upper portion of the ladder is at a desired position, a locking mechanism engages between the two ladder portions to enable safe climbing of the ladder, and the ladder is tilted to rest at an angle against the structure to be climbed.

For safe use of the extension ladder, the ladder is used on level or substantially level surfaces. If the surface is not substantially level, such as on a hill, steps, or any uneven surface which cannot evenly support the two legs of the extension ladder, safe use of the ladder is a problem. To address this problem, ladder levelers have been proposed which are either attached to one of the legs to extend the leg, such as shown for example in U.S. Pat. No. 3,933,222 to Craig, Jr., or attached to rungs adjacent to or near one leg of the two ladder's legs to effectively extending that leg, such as shown in U.S. Pat. No. 4,984,655, to Scherer et al., or U.S. Pat. No. 5,121,813 to Funston, or attached to both one of the ladder's legs and its rungs, such as shown in U.S. Pat. No. 5,174,412 to Vega. Other ladder levelers proposed have two separate devices each attached to one of the ladder's legs and are adjustable in length, such as shown in U.S. Pat. No. 6,435,306, to Stoneburg. A further more complicated ladder leveler is described in U.S. Pat. No. 6,378,656 to Kohler, which has a single unit attached to the bottom of both of the ladder's legs, and has two pivotal arms which lie on a surface.

In all of these ladder leveler devices, the ladder combined with the leveler device distributes the weight of the ladder down both of the ladder's legs to the ground, or other surface, via the ladder leveler device. Moreover, in most ladder leveler devices the devices need to be readjusted (e.g., in height) for use with the same ladder on different uneven surfaces, or removed from the ladder to enable use of the ladder on level surfaces. When a ladder leveler device is not present or not desired, holes are sometimes dug in a surface if possible, as in the case of a dirt or loose ground surface, to support one or both ladder legs, or block(s) of wood or other rigid material are sometimes placed under one or both ladder legs, to enables the feet of the ladder to be substantially level. However, these block(s) or leg(s) in dug holes can shift during ladder use creating a safety hazard to a climber on the ladder, and/or require another person to hold onto the ladder when used. Thus, a device easily attachable to an extension ladder, which is not a ladder leveler, is not complex, and enables the ladder to be used on level and non-level surfaces without modification (such as height adjustment) or removal of the device would be desirable.

SUMMARY OF THE INVENTION

Accordingly, it is an object of the present invention to provide an apparatus attachable to an extension ladder which supports the ladder on a single leg, rather than on two legs extended all, or in part, by a ladder leveler device of the prior art, which enables the ladder to be used on different ones of level and non-level surfaces without modification or removal of the apparatus.

It is another object of the present invention to provide an apparatus attachable to a ladder which supports the ladder on a single leg whereby a user can extend (or retract) the ladder by himself or herself without the ladder spinning and possibly causing a dangerous situation by the user losing control over the ladder.

Briefly described, the apparatus (or attachment) embodying the present invention has a single leg extendable in a direction perpendicular and adjacent to the two lowest rungs of the lower ladder portion of an extension ladder, a channel bar attached perpendicular to the leg sized to receive a substantial length of a lowest rung of the lower ladder portion, a hook attached to the leg for latching onto a next to lowest rung of the lower ladder portion, a foot pivotally mounted to the leg at one end thereof to pivot the leg and foot with respect to each other along an axis of rotation, and a step member attached to the leg between the channel bar and the foot by one of more extension members at a downward angle to enable the step member to rotate upwards in a backward direction when the leg is rotated about the axis of rotation forward with respect to the foot. Such step member assists a user in ascending and descending the ladder, and if desired assists the user in seating the apparatus's foot on a surface. The apparatus further has a holder attached to the leg and an opening extending through the holder through which an arm member (such as a dowel, rod, or shaft) is receivable for extending from the leg at a downward angle to enable the arm member to rotate upwards in a backward direction when the leg is rotated about the axis of rotation forward with respect to the foot.

The angle of the extension members for the step member, and the angle of the arm member and the holder opening for receiving same, may be the same or different from each other. When the leg of the apparatus is attached by the channel bar and the hook to the two lowest ladder rungs, the ladder is elevated from the surface by the apparatus and non-contact with the surface, thereby providing a single support to an extension ladder enabling the ladder to be use on level and non-level surfaces. This is a result of the leg extending from the channel bar to the foot further than the lowest rung extends to lowermost part of the ladder's two legs.

When the leg is attached to the ladder's rungs by the hook and channel bar, and the upper portion of the extension ladder is being extended by a user upwards with respect to the lower portion of the extension ladder, such arm member is received through the opening of the holder such that the arm member lies against the user's leg to stabilize the assembly of the apparatus attached to the ladder and thereby prevent the ladder from spinning upon the attachment's leg and foot. This arm member may be removed prior to the user climbing the ladder at its new extended height. The arm member may also be provided when the upper ladder portion is lowered with respect to the lower ladder portion by a single user.

The present invention also provides a method for attaching a single leg support to an extension ladder to enable the ladder to be use on level and non-level surfaces. The method having the steps of: providing a leg extendable in a direction perpendicular and adjacent at least the two lowest rungs of the lower ladder portion of an extension ladder; receiving in a channel of a bar along the leg a substantial length of a lowest rung of the lower ladder portion; latching the next to lowest rung of the lower ladder portion to the leg; pivotally mounting the leg at one end thereof to a foot to support the leg when present onto or at least particular into a level or non-level, in which the leg and the foot pivot with respect to each other along an axis of rotation; providing a step extending from the leg at an angle to enable the step member to rotate upwards in a backward direction when the leg is rotated about the axis forward with respect to the foot, in which the step extends from the leg between the bar and the foot; and providing an arm extending from the leg to enable the arm when located in a holder along the leg to stabilize the ladder against the leg of a user when the upper portion of the ladder is pulled via a rope upwards by the user to slide the upper portion with respect to the lower portion of the ladder in order to raise the ladder, and the arm is removable from the holder when the user climbs the ladder using the step. The arm when located in the holder may extend at an angle with respect to the leg to enable the arm to rotate upwards in a backward direction when the leg is rotated about the axis forward with respect to the foot.

The apparatus provides an attachment for an extension ladder which enables the ladder to be used on level and non-level surfaces without modification (e.g., height adjustment) or removal of the apparatus from the ladder.

BRIEF DESCRIPTION OF THE DRAWINGS

The foregoing and other objects, features and advantages of the invention will become more apparent from a reading of the following description in connection with the accompanying drawings in which:

FIG. 5 shows partially the ladder to illustrate use of the step member of the apparatus, and FIG. 6 shows same ladder as FIG. 5 with a user on the upper portion of the ladder;

DETAILED DESCRIPTION OF THE INVENTION

Figure 1:
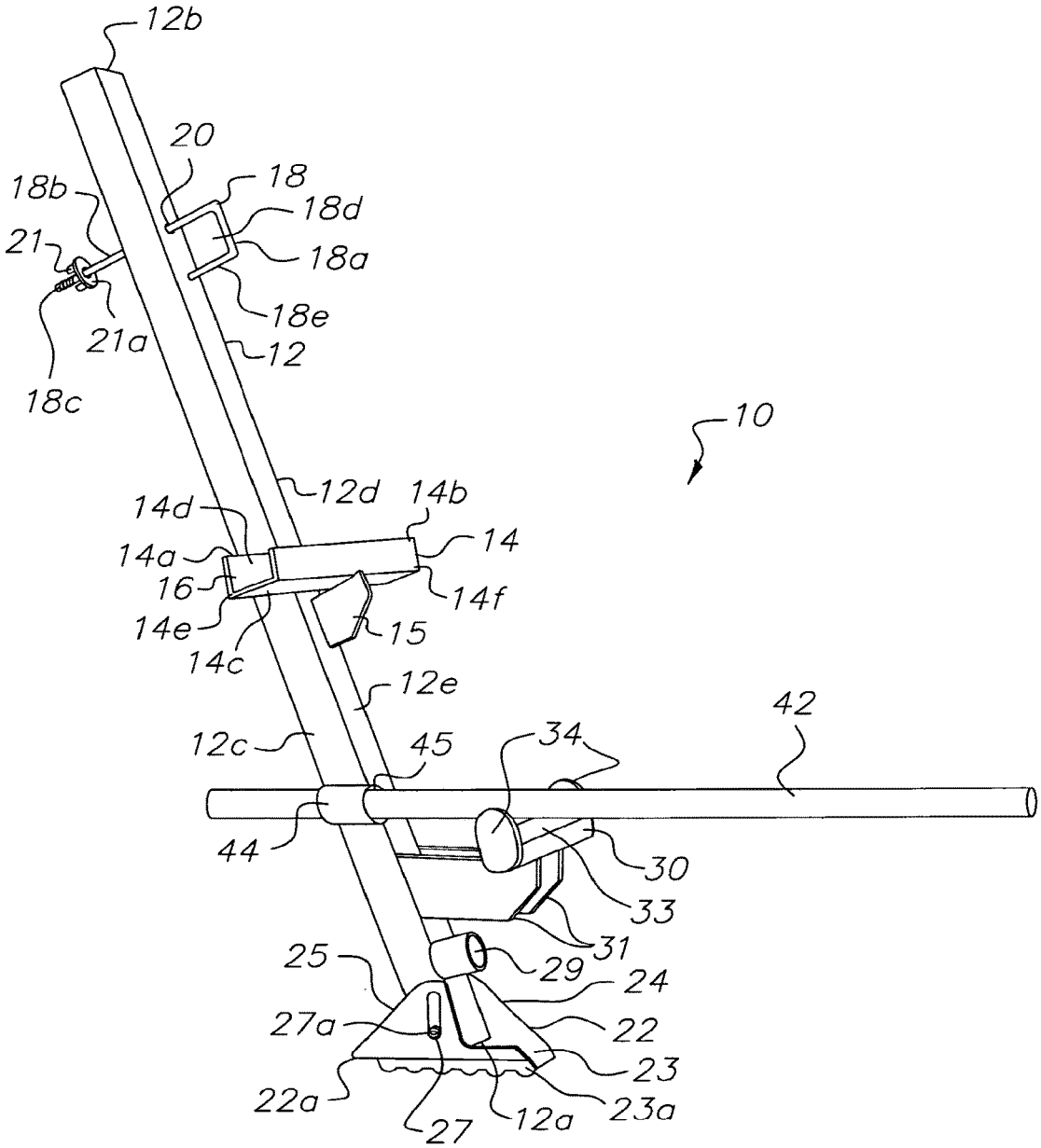
FIG. 1 is a perspective view of the apparatus of the present invention in which the leg of the apparatus is rotated forward with respect to the foot of the apparatus.
Figure 2:
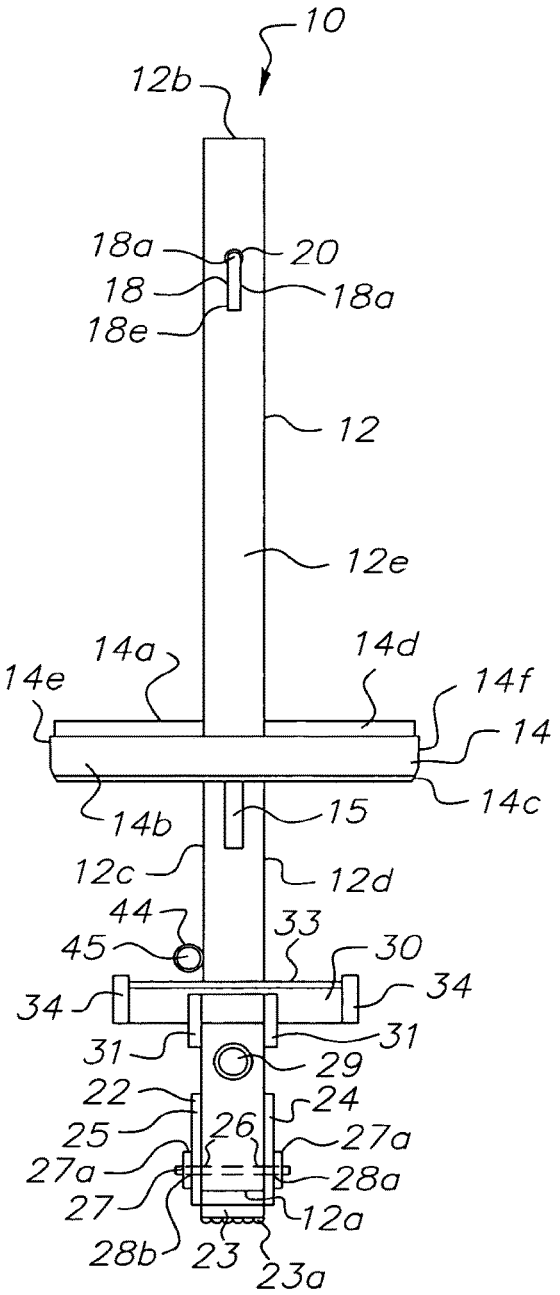
FIG. 2 is a front schematic view of the apparatus of FIG. 1.
Figure 3:
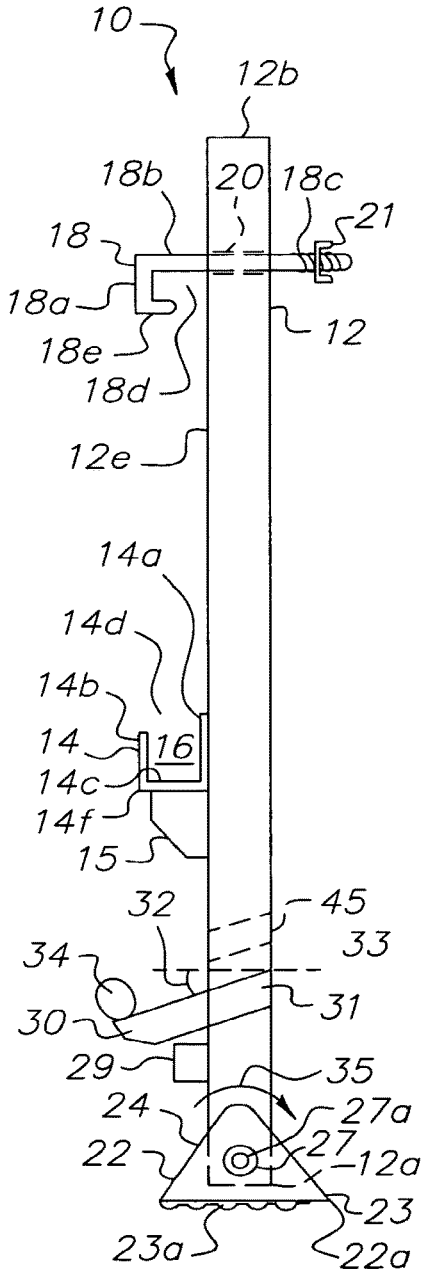
FIG. 3 is a side schematic view of the apparatus of FIG. 1.

Referring to FIGS. 1, 2, and 3, an apparatus (or attachment) 10 of the present invention is shown having a leg 12 having two opposite ends 12*a* and 12*b*. For example, leg 12 may be a hollow square shaft of 1 ½ inch width per side, a length of 36 inches, and of 6061 aluminum material. A channel bar 14 is attached perpendicular to the leg and supported by a gusset (or bracket) 15. Channel bar 14, leg 12, and bracket 15 are attached to each other as shown in FIG. 1, such as by welding, but other attachment means may be used with or without bracket 15, such as by nuts and bolts. Due to such attachment to leg 12, channel bar 14 is non-adjustable in position along leg 12. The channel bar 14 has a U-shaped cross-sectional channel 16 defined by two opposite side walls 14*a* and 14*b*, a flat bottom 14*c*, and an opening 14*d*, in which side wall 14*a* closer to leg 12 is slightly higher than side wall 14*b*. The channel 16 is sized to receive a rung of typical extension ladder. For example, side wall 14*a* may be 1 ⅝ inches in height; side wall 14*b* 1 ¼ inches in height, gusset ¼ inches thick, and the distance between the two side walls (i.e., width of channel 16) of 1 13/16 inches. Walls 14*a*, 14*b*, and 14*c* may each be ⅛ inches thick. Channel bar 14 is centrally attached about its length with respect to leg 12, and extends a substantial length of a rung (such as at least half the rung length) when a rung is received in its channel 16, but less than an entire rung length. When a rung is received in its channel 16, preferably the channel bar 14 is at least approximately centered about the rung between the two ladder's legs, and each end 14*e* and 14*f* of channel bar 14 is spaced a distance from one of the two ladder's legs (see e.g., rung 40*a* of FIG. 4). This distance varies depending on the overall length of the rung. For example, channel bar 14 is at least 10 inches in length, preferably 10 ½ inches. Ladder rung lengths vary by ladder manufacturer, but a common rung length for an extension ladder is 17 inches. Alternatively, channel bar 14 may extend the entire length of a rung, but this is less preferred since sometimes a rung has support members or braces near the two ladder's legs which if present would interfere with rung entry into channel 16. The length along leg 12 from channel bar 14 to shaft end 12*a* may be, for example, 16 inches.

A hook 18 has a hook portion 18*a* extending to a straight portion 18*b*. The straight portion 18*b* extends through a hole 20 in the leg 12, and end 18*c* of the straight portion 18*b* is threaded for about 3 inches from its end so that a wing nut 21 can be screwed onto such end 18*c*. The hook 18 may be J-shaped and sized to receive a rung of a typical ladder in hook opening 18*d*, which extends from a hook end segment 18*e* and the part of the straight portion 18*b* opposite hook end segment 18*e*. A washer 21*a* is provided along straight portion 18*b* between leg 12 and nut 21. The wing nut 21 is used to enable hook 18 to latch a rung against leg 12 when received in hook portion 18*a*, and thus clamp hook 18 onto the rung. The interior width of hook opening 18*d* is equal to (or slightly more than) the width of a typical rung, such as 1 ½ inches, and end segment 18*e* may be about 1 inch long or other length sufficient to capture a rung in opening 18*d*. For example, hook 18 may be a stainless steel J-bolt which is ⅜ inch diameter, and bent to provide a hook as shown in the figures. Hole 20 of leg 12 is slightly larger in diameter than the diameter of hook 18 so that the straight portion 18*b* is movable longitudinally there through so as to enable capture and release of a rung by adjustment of nut 21. When a rung of a ladder is latched to leg 12 by hook 18, the nut 21 is hand tightened against leg 12 via washer 21*a*. The hole 20 for hook 18 is spaced a distance from the bottom of channel 16 of channel bar 14 so that when the channel 16 of bar 14 receives a lowest rung of a lower ladder portion of the extension ladder the hook 18 can receive and retain the next to lowest rung of the ladder, as shown for example in FIGS. 4 and 6. For example, hole 20 and bottom of channel may be a distance of 13 7/16 inches from each other.

The channel bar 14 and hook 18 are members dimensioned to receive the two lowest rungs of a ladder along their respective exterior. For example, in the case of an extension ladder having rungs that are D-shaped in cross-section, i.e., a convex circular bottom and a horizontal top, the width along the rung's top may be 1 ⅝ to 1 ¾ inches, the rung's height from bottom to top may be 1 ½ inches, and the rung's length between two ladder's legs may be at or about 12 to 18 inches. In this example, channel bar 14 and hook 18 of apparatus 10 may have, for example, the following dimensions: hook opening 18*d* interior width at or approximately 1 ½ inches in order to capture a rung; channel 16 of 1 ¾ inches to 2 inches in width (preferably 1 13/16 inches); and channel bar 14 length at or greater than 10 inches, but less than 15 inches (preferably at or approximately 10 ½ inches). Thus, the same one of apparatus 10 can be used with a variety of different ladders of the same or different manufacturers having D-shaped rungs, or other cross-sectional shaped rungs (e.g., circular, rectangular, square, etc. . . .) having at or about 1 ½ inches rung height, and other dimensions in or about the above stated ranges. The spacing between two adjacent rungs, as in the case of the lowest two rungs of a ladder, is generally the same between different extension ladders. The apparatus 10 may have its channel bar 14 and hook 18 sized to accommodate still other ladders (i.e., extension or non-extension types having only two legs for supporting the ladder upon a surface), so long as the two lowest ladder rungs have an exterior that can engage (lock, latch, or clamp) apparatus 10 via such rungs into channel bar 14 and hook 18 as shown for example of rungs 40*a* and 40*b* in FIGS. 4-6. Thus, one feature of the invention is that the apparatus 10 can be used with a variety of different ladders.

A foot 22 is pivotally mounted to end 12*a* of leg 12. The foot 22 may be a typical swivel foot as used at the bottom of one of the legs of a typical extension ladder. Preferably, foot 22 has base or bottom wall or surface 23 with non-skid material 23*a* as typical of an extension ladder to assist in griping a surface, such as corrugated or grooved rubber. Extending upwards from the sides of the base 23 are two parallel flanges or triangular walls 24 and 25. A bolt, shaft, or pin 27 passes through a hole 28*a* of wall 24 (or 25), through hole 26 in each side 12*d* and 12*c* of leg 12, and then through a hole 28*b* of wall 25 (or 24). The two ends of bolt 27 are threaded and each has a nut 27*a* retaining the foot 22 onto leg 12 while enabling the foot to swivel or pivot as desired about an axis of rotation defined by the center through the length of bolt 27. One or both nuts 27*a* may be tightened as desired to lock the pivot position of leg 12 with respect to foot 22, and untightened to allow the foot to freely pivot about its axis of rotation about bolt 27. Such axis of rotation may be parallel to a dimension of the length of channel bar 14. For example, each of the hole 26 of leg 12 may be centered about ¾ inches from leg end 12*a*. Foot 22 helps prevent apparatus 10 from kicking out when apparatus 10 is attached to a ladder and presented upon a surface at a desired tilt with the ladder.

Figure 5:
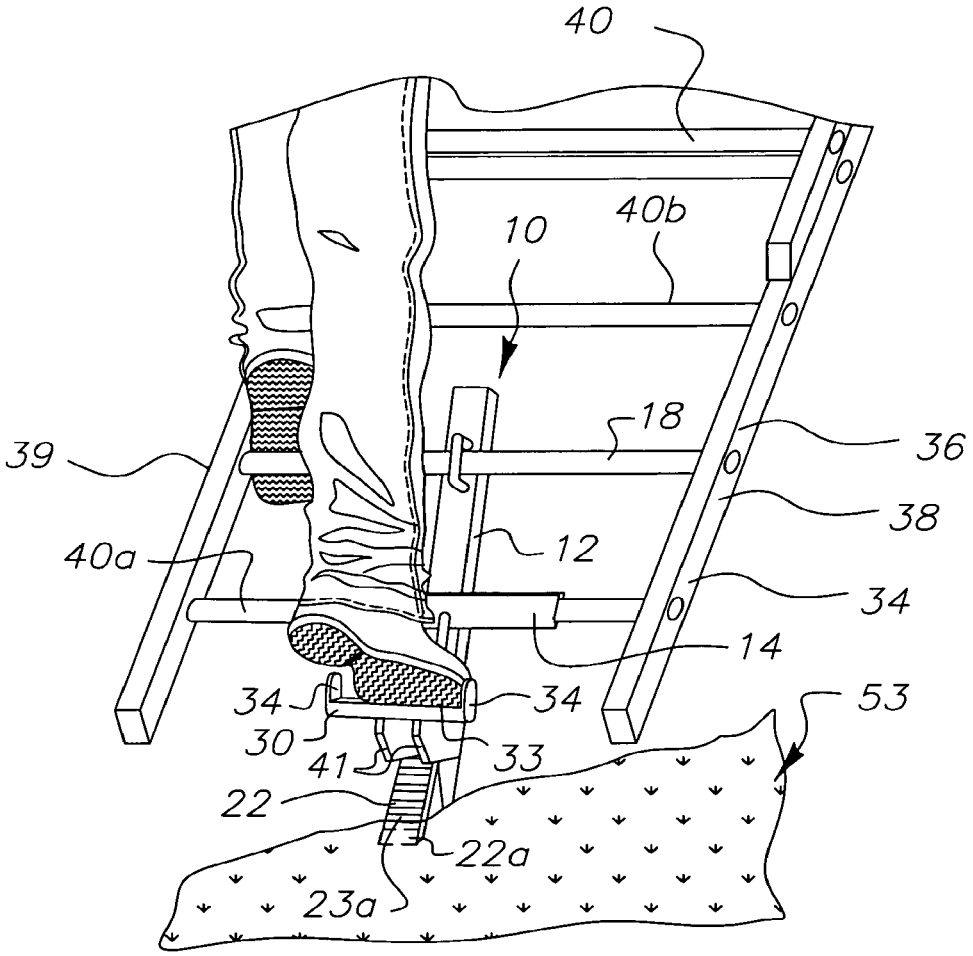
FIGS. 5 and 6 are two perspective views showing another example of the attachment of FIG. 1 when attached to an extension ladder, where

A stop or spacer 29 is attached to side 12*e* of leg 12 above the foot 22 so that interior of the bottom wall of foot 22 will abut stop 29 when the foot is pivoted (or rotated) against stop 29, so that such stop 29 thereby provides a stopper which stops the top of foot 22, such as 1 inch, away from leg 12. The foot 22 when so pivoted, base wall 23 lies at least approximately parallel with leg side 12*e*, enabling the back 22*a* of foot 22, sometimes called an "ice pick", to be used to anchor apparatus 10 into a depth below a surface when needed for support, such as digging into ice, dirt, or other such material, such as shown in FIG. 5. The bottom of stop 29 may be about 2 ¼ inches from leg end 12*a*. For example, stop 29 may be a 1 inch diameter aluminum pipe attached to leg 12 as shown in the figures, however stop 29 may be a hollow or solid square, cylindrical, or other shape, and of other materials (e.g., rubber or polymeric) and attached by other means, e.g., adhesive or bolt and nut, to leg 12.

A step member 30 is attached to leg 12 between channel bar 14 and foot 22 by two extension members or flanges 31 which extend from along sides 12*c* and 12*d*, respectively. Members 31 are attached to leg 12 at a downward angle 32, such as 18 degrees, with respect to the normal 33 of a dimension extending along the leg's linear length between ends 12*a* and 12*b* of leg 12, as best shown in FIG. 3. However, other acute angular dimensions may be used. Members 31 may, for example, extend from leg 12 at angle 32 for about 6 inches. Step member 30 is attached at the end of the members 31 along the top thereof. For example, step member 30 may be a cylinder or pipe of about 6 inches centered about extension members 31. The two ends of step member 30 each have an end member 34. The stepping surface of step member 30 preferably has a non-skid (or skid resistance) layer 33 between end members 34. Such layer 33 may be attached by adhesive to step member 30 along an upper area thereof, or represent a coating applied to step member 30.

The attachment of step member 30 to leg 12 by members 31 at angle 32 is such that when leg 12 is rotated in a forward direction indicated by arrow 35 (FIG. 3) along the axis of rotation defined by bolt 27 of foot 22, such as to the position shown in FIG. 1, step member 30 rotates upward in the reverse direction to arrow 35 to raise step member 30 to a sufficient height to facilitate use of the step member as a step for climbing (or descending) ladder 12 when attached to apparatus 10. Such angular rotation at or approximate to the degrees of angle 32 will extend step member 30 at or approximately horizontal. However, the amount of angular rotation depends upon that desired by the user for the particular ladder application. Although two members 31 are shown, alternatively, other attachment means to leg 12 may be used, such as single member (e.g., flange, bracket, or shaft) extending from leg 12 to step member 30 a sufficient length to enable use as a step and capable of supporting the weight of a user or person when applied by the user's foot to step member 30. For example, step member 30 may be a 1 inch diameter pipe having ⅛ inch thick wall, and a length of 6 inches. End members 34 are located at the ends of the pipe, and extension members 31 are attached centered about the pipe's length.

The leg 12, bar 14, stop 29, members 30, 31, and 34, are preferably made of aluminum, and hook (or J-bolt) 18, washer 21*a*, and wing nut 21, are preferably made of stainless steel. Other materials may be used, in which weight bearing components, e.g., leg 12 and bar 14, are of material suitable for sustaining loads when present upon of a ladder. Foot 22 may be a commercially available ladder foot made of steel with a rust resistant coating. Bolt 27 and nuts enabling foot pivotal attachment to leg 12 may also be the same as those in attaching a typical swivel type foot to an extension ladder. Leg 12, bar 14, hook 18, stop 29, foot 22, members 30, 31, and 34 are attached as described above and shown in FIG. 1, such as by welding, or other attaching means may be used.

Figure 4:
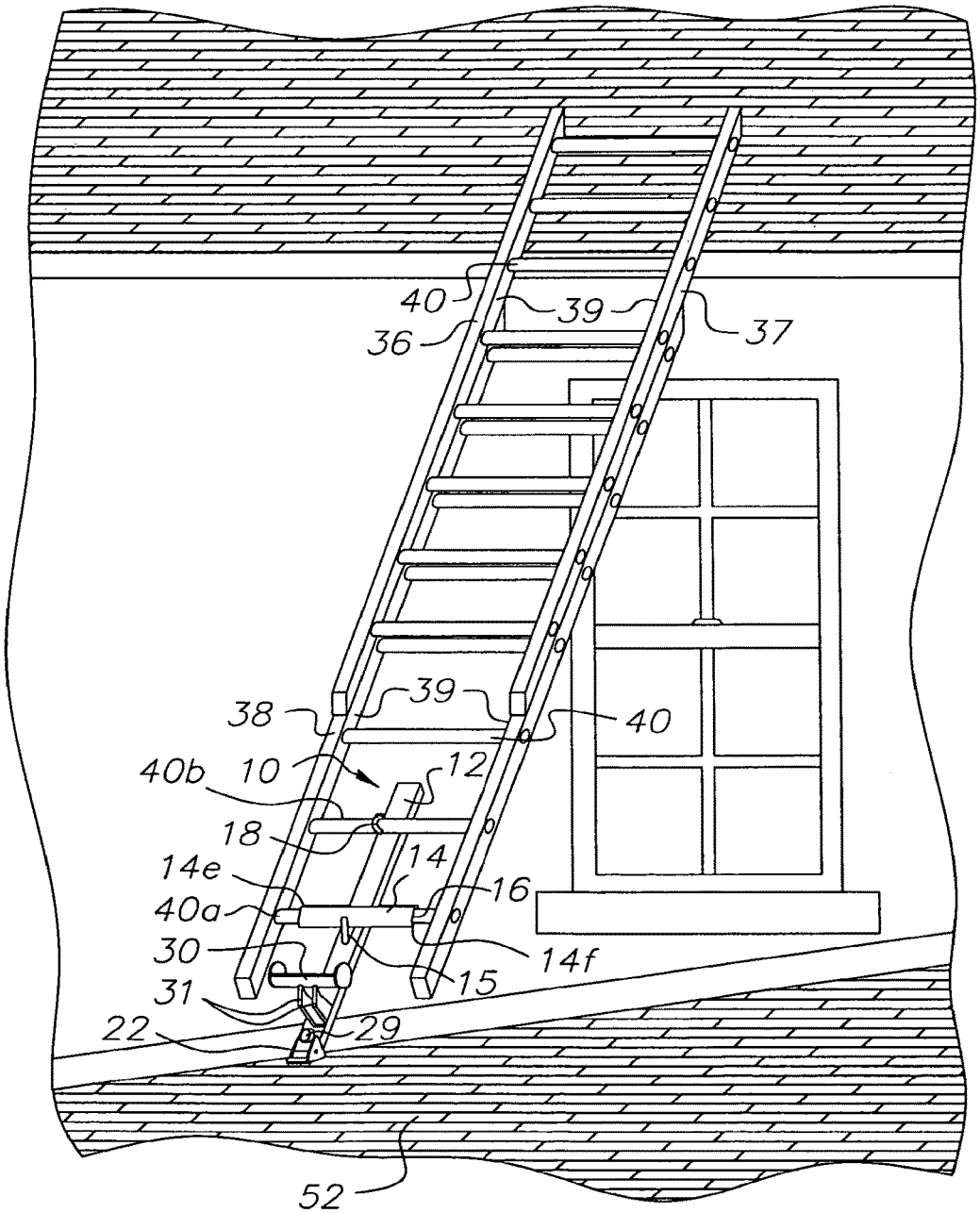
FIG. 4 is a perspective view showing an example of the apparatus of FIG. 1 attached to extension ladder along an angled surface and the ladder resting against a building structure.
Figure 6:
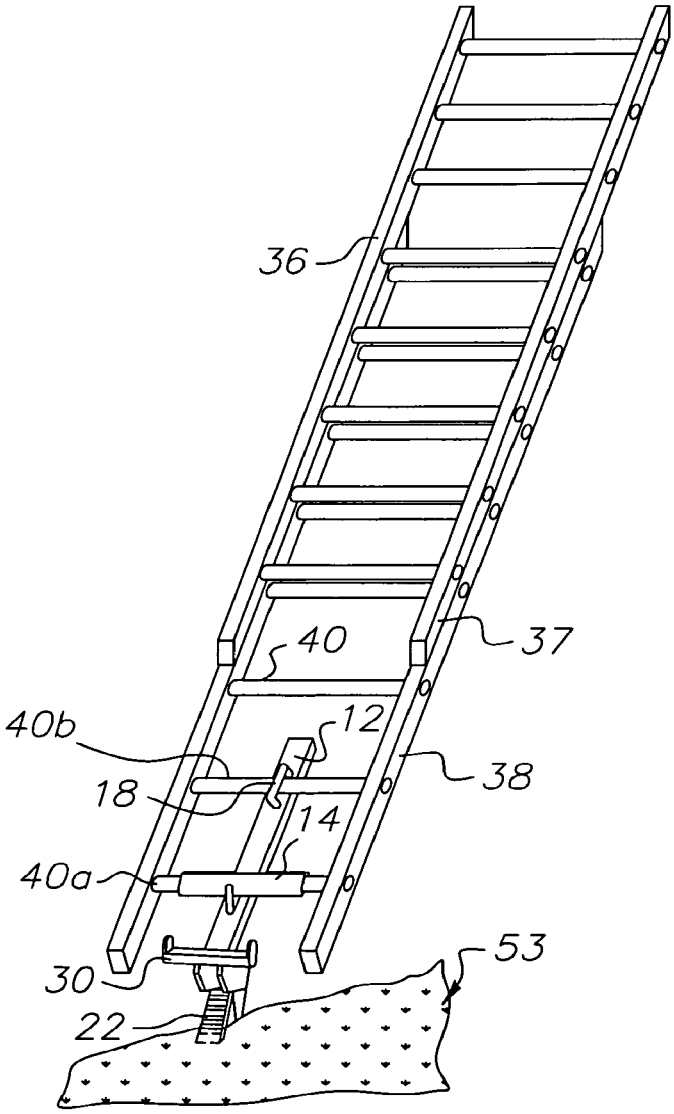

The attachment of apparatus 10 to a typical extension ladder 36 is best shown in the examples of FIGS. 4, 5, and 6. Extension ladder 36 has an upper ladder portion 37 and lower ladder portion 38 which slides with respect to each other to adjust the height of the ladder 36, as typical of extension ladders. Each portion 37 and 38 has two long structural members or sides, called herein legs 39, which are coupled by equally spaced parallel rungs 40. The apparatus 10 is attached to ladder 36 when no person is on the ladder. Leg 12 is positioned adjacently behind at least the lower two rungs 40*a* and 40*b* so that the leg 12 extends perpendicular to such rungs, and the lowest rung 40*a* is received in channel 16 of channel bar 14, preferably centered or approximately centered between the lower portion's two legs 39. With leg 12 extending perpendicular to rungs 40*a* and 40*b*, leg 12 extends parallel to legs 39 of ladder 36, as shown for example in FIG. 4. With nut 21 and washer 21*a* positioned on hook portion 18*a*, but away from leg 12, as shown for example in FIG. 3, the next to lowest rung 40*b* is received in opening 18*d* for capture by hook 18 as described earlier, nut 21 is then tightened to latch rung 40*b* to leg 12, as shown in FIG. 4. There is no attachment of apparatus 10 to the legs 39 of ladder 36; the ladder is attached to apparatus 10 and supported solely by its two rungs 40*a* and 40*b*.

The ladder 36 when used is on a tilt such as shown in FIGS. 4-6 and leg 12 corresponds to such tilt by pivoting about its foot 22 which rests on a level or non-level surface. In FIG. 4 for example, this surface is an angled roof 52, while in FIGS. 5 and 6, the foot is pivoted against stop 29 and back 22*a* of foot 22 enters into the ground along the side of a hill 53 sufficient to anchor the apparatus 10 and ladder attached thereto. With foot 22 situated on or into (at least partially) a surface, and apparatus 10 is rotated or pivoted forward about axis of rotation along arrow 35 with the desired tilt of ladder 36 to a position enabling a user or person to climb the ladder with a top thereof resting upon a structure, step member 30 simultaneously rotates upwards in the reverse rotational direction to direction of arrow 35 to project step member 30 backwards and outwards approximately horizontally, as shown in FIGS. 5 and 6, or more than horizontal, as shown in FIG. 4, or less than horizontal, depending on the degree of ladder tilt desired and amount of angle 32. The leg 12 may be at the same or different position with respect to foot 22 than shown in FIG. 3 when attached to ladder 36.

Step member 30 has two functions. First, the step member 30 may be used for seating the foot 22 of apparatus 10 onto or at least partially into a surface (such as the ground) by the user applying with one of his or her feet downward force upon the stepping surface of step member 30 with the other one of his or her feet upon such surface. Typically, without the apparatus 10, such seating is performed using the lowest rung of the ladder, but here due to the lowest rung's increase height from the ground (or other surface) with attached apparatus 10, step member 30 is used. Ladder 36 is usable without such seating, but seating of the assembly of apparatus 10 and ladder 36 is preferred to reduce the chance of slippage of the assembly during use. Second, step member 30 is used as a step to assist a user in climbing or ascending the ladder 36, as shown for example in FIG. 4, and for descending the ladder. Material 33 on step member 30 assists in reducing the risk of user foot slippage.

Along the bottom of the two legs 39 of lower ladder portion 38 may be swivel feet which are not used when apparatus 10 is attached to ladder 36. As such, the length along leg 12 from channel bar 14 to foot 22 is sufficient to elevate the two legs 39 of lower ladder portion 38 (and its swivel feet, if present) a distance from the level or non-level surface (and thus the ladder is non-contact with such surface). In other words, leg 12 extends from channel bar 14 to the bottom 23 of foot 22 further than the distance of the lowest rung along the ladder's two legs 39 to lowermost part or end of the ladder. Ladder 36 with apparatus 10, attached via only rungs 40*a* and 40*b*, may be moved to any level or non-level surface as desired without any modification (e.g., height adjustment) or removal of apparatus 10, since the foot 22 can pivot and engage such surface either along material 23*a*, or by digging into the surface via foot's back angled portion 22*a*, as needed.

In the example of FIG. 4, the angle of roof 52 cannot provide a sufficiently level surface for ladder legs 39 of the lower ladder portion 38 to be used upon roof 52 without apparatus 10 attached to ladder 36 to provide a single support upon the roof 52. Similarly, in FIGS. 5 and 6, hill 53 also represents a non-level surface which cannot provide a sufficiently level surface for legs 39 of the lower ladder portion 38 (even with the swivel feet at the ends thereof) to be used without apparatus 10 attached to ladder 36 to provide a single support level on hill 53. In a further example of FIGS. 7A-C, the same ladder of FIGS. 4-6 may also be used with apparatus 10 on an approximately or substantially level surface, such as provided by ground 54.

The ladder apparatus 10 distributes all weight of ladder 36 to one point down leg 12, thereby providing a single support attachment for the ladder. This is facilitated by channel bar 14 extending substantially the extent of rung 40*a*. Preferably, leg 12 is centrally (or at least approximately centrally) located between legs 39 of the lower portion behind rungs 40*a* and 40*b*, so that channel bar 14 and hook 18 are centrally (or at least approximately centrally) positioned along their respective rungs to promote ladder 36 stability when used.

Apparatus 10 is thus different from ladder levels, as described earlier, which distributes all weight of the ladder to two points along a surface. In other words, the weight of the ladder is distributed down both legs to the ground in which one or both of the legs are extended so that the ladder is level or approximately level. The ladder leveler devices of U.S. Pat. Nos. 4,984,655 and 5,121,813 utilize only rungs of a ladder are designed to distribute only part of the ladder weight along one side (i.e., leg) of a ladder, thus effectively extending one of the ladder's two legs. If devices of U.S. Pat. Nos. 4,984,655 and 5,121,813 were instead attached to a ladder to support the entire weight of the ladder on a surface, such would be extremely problematic due to inherent resultant ladder instability due to the manner in which their devices clamp onto the ladder. Ladder instability is undesirable since its can cause the ladder to tip as weight of a person is applied or shifted when present upon the ladder or when the body of limbs of a person on the ladder is extended from the ladder. Thus, not until the present invention has a single leg ladder support been safely attainable.

Due the ladder apparatus 10 distributing all weight of ladder 36 to one point down leg 12 to its foot 22, when upper portion of the ladder is extended from the lower portion as typically manually performed by a user pulling on a rope 41*a* attached near the bottom of the upper portion which is fed through a pulley 41*b* attached near the top of the lower ladder portion, would cause the ladder to undesirably spin or rotate about leg 12 and foot 22 causing the user to lose control and possible result in a dangerous situation. To avoid this situation, an arm member 42 is provided as shown in FIG. 1 to prevent spinning from occurring when a user raises or lowers the ladder by him or herself. Arm member 42 may be a dowel, as shown in FIG. 1, or a rod or shaft receivable in a holder 44 attached to side 12*c* of leg 12 about flanges 31. However, unlike channel bar 14 and hook 18 which are members along leg or shaft 12 that engage the two lowest rungs of a ladder, arm member 42 is non-rung engaging by being coupled to leg or shaft 12, via its holder 44, below the ladder rungs, as shown for example in FIGS. 7A-C. The holder 44 provides an opening or tube 45 extending through holder 44 and is of a size and shape to receive arm member 42, such that arm member 42 is slideable through opening 45. The opening 45 preferably extends at the same downward angle as members 31 for step member 30; however other acute angle to the normal of a linear dimension along the leg's length may be used. For example, opening 45 may be circular in cross-section to provide a tube having a diameter slightly larger than the diameter of the arm member 42 to enable the member 42 to be inserted and removed from tube 45, as needed. The holder 44 along leg 12 thus enables attachment and detachment of arm member 42 from leg 12. For purposes of illustration, arm member 42 is removed from holder 44 in FIGS. 2 and 3, and hidden from view in FIGS. 4 and 5.

Figure 7A:
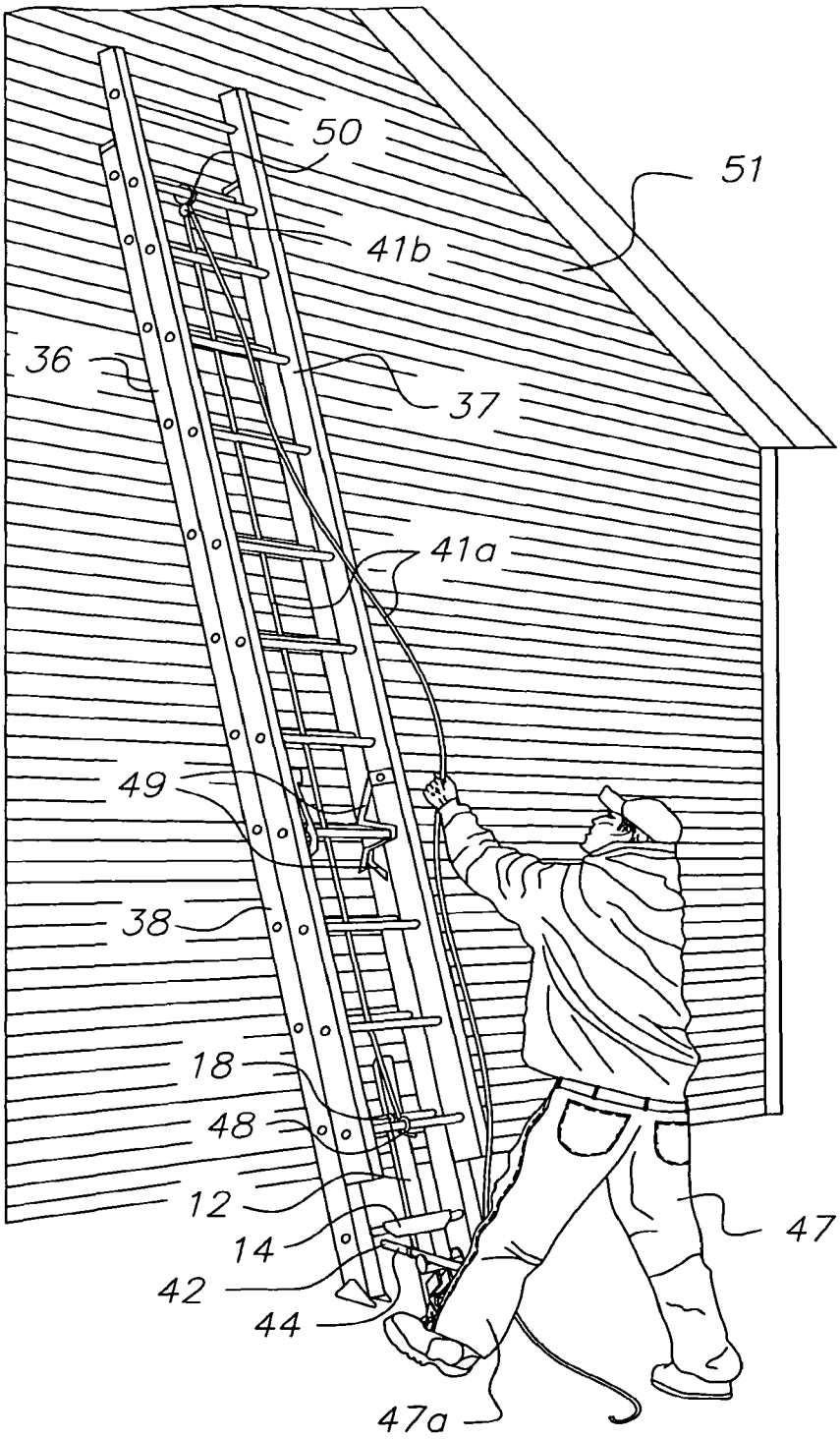
FIGS. 7A and 7B are examples illustrating the apparatus of FIG. 1 in use when attached to an extension ladder, where an arm member, such as a dowel, of the apparatus is present to prevent the ladder from spinning upon the leg and foot of the apparatus when a rope in pulled by a user to raise the ladder such as from the position in FIG. 7A to the position in FIG. 7B.
Figure 7B:
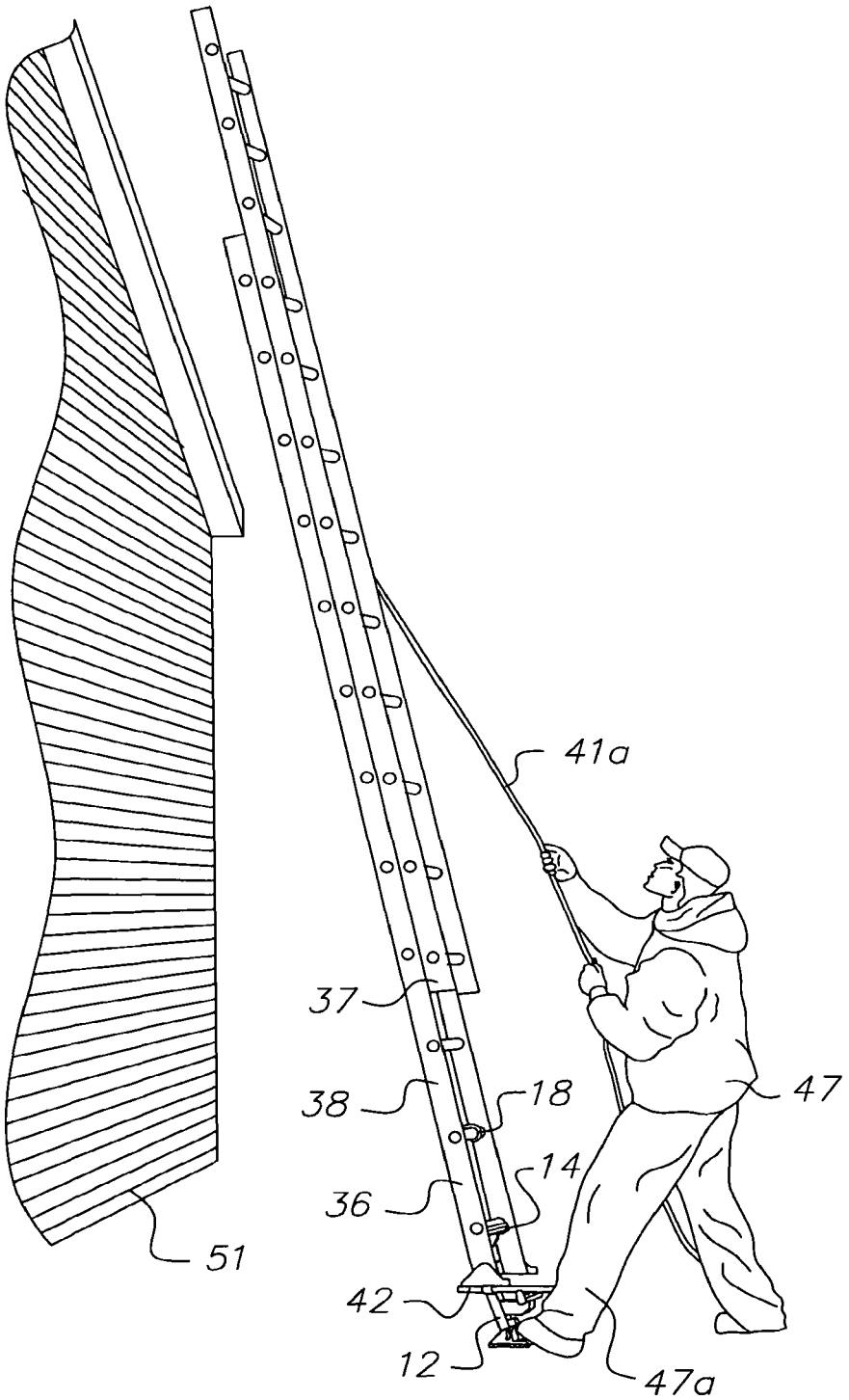
Figure 7C:
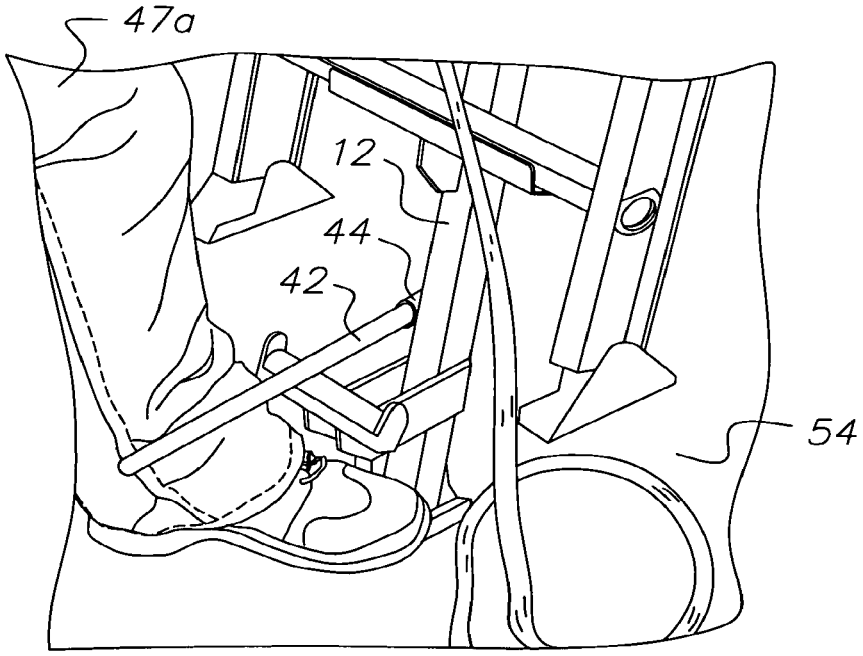
FIG. 7C is a more detailed view of the position of the arm member of FIGS. 7A and 7B abutting the leg of the user manually raising the extension ladder.

FIGS. 7A-C illustrate the extending of ladder 36 using arm member 42. With the user 47 on the ground, and arm member 42 coupled to leg 12 via holder 44, the user pulls on a rope 41*a* attached near the bottom of the upper ladder portion 37, such as by a knot 48 about a rung, which is fed through a pulley 41*b* attached near the top of the lower ladder portion 38, such as to rung 50. While pulling on the rope 41*a*, the ladder 36 extends in the air and is not leaning on any surface which could hinder the sliding of the upper ladder portion 37. Also, pulling upwards the upper ladder portion 37 via rope 41*a* automatically release a locking mechanism 49 between the two ladder portions 37 and 38, or the user may operate the locking mechanism to disengage, as typical of an extension ladder to allow upper ladder portion 37 to slide with respect to lower ladder portion 38.

To stabilize ladder 36 when ladder portion 37 is being so extended, and thereby prevent spin of the ladder about leg 12 and foot 22 upon or in a level or non-level surface the arm member abuts a generally stationary member (i.e., a separate an external member apart from apparatus 10) provided by the user's leg 47*a* lying against arm member 42, such as illustrated in FIG. 7C. The arm member 42 is sized so as to extend away from leg 12 at least a sufficient distance to enable abutment with a user's leg when needed for stabilization. If desired, the user's foot may also be applied upon foot 22 to provide additional ladder stability (see FIG. 7C). When the top of the ladder (top of the upper ladder portion 37) is at a desired position, locking mechanism 49 engages when the rope 41*a* is slowly released by the user, and the ladder 36 is then tilted by the user using rope 31*a* or ladder 36 to rest the ladder at an angle against the structure to be climbed with the ladder. Prior to climbing the ladder, preferably arm member 42 is removed from holder 44. Thus, arm member 42 is detached from apparatus 10 when a user is present on ladder 36. Arm member 42 may also be placed in holder 44 when upper ladder portion 37 is lowered with respect to lower ladder portion 38, if desired, to similarly prevent spin of the ladder 36 about the leg 12 and foot 22. The ladder 36 is shown as an example of one type or model of ladder which apparatus 10 can attach to for supporting the ladder, other ladders may similarly be used with apparatus 10. As described above, arm member 42 shown for example in FIGS. 7A-C is utilized after leg 12 is attached to ladder 36 by channel bar 14 and hook 18 to elevate the ladder to a height, along its bottom, above the level or non-level surface. As a result, such height of the ladder is set independent of arm member 42 being extended to the external member provided by user's leg 47*a*.

Preferably, anything capable of sliding into the opening 45 of holder 44 may be used to prevent spin of ladder 36 and attached apparatus 10 for stabilizing the ladder when the upper ladder portion 37 is moved in a controlled manner with respect to lower ladder portion 38. This allows a user, such as a contractor, to use anything in a pinch, such as dowel rod, long screw driver, jack handle, tree branch, etc., as one of arm member 42. Preferably, a dowel rod painted florescent color, such as orange, is used. For example, the dowel may be about 24 inches in length, and 1 inch in diameter. The color facilitates locating the arm member 42 on a job site.

As described above, with the arm member 42 providing an extension inserted in (and preferably through) holder 44, the arm member 42 extends from leg 12 at an angle (non-zero) to go against the user's leg 47*a*, and stabilizes the ladder, holding it square with respect to a building 51 in the example of FIGS. 7A-C. The user 47 is able to continue pulling the rope 41*a* as shown in FIG. 7B, in order to extend the ladder 36 higher, where the user's leg provides a stop against arm member 42 preventing ladder spin. Once the ladder is extended and resting against the building 51 again, the arm member 42 can be removed from holder 44. Removing the arm member 42 from holder 44 does away with a potential tripping hazard, as well as making the ladder lighter to maneuver. The user can now go up and down the ladder safely. Thus, the user's leg is temporarily fixed or placed near foot 22 of leg 12 of apparatus 10 against arm member 42 when needed for raising or lowering the ladder (see e.g., FIG. 7A), and not at other times when the user is on the ladder (see e.g., FIG. 5). In other words, the arm member 42 is preferably used when raising or lowering the ladder 36 when the ladder is not against a structure, e.g., building as shown in FIGS. 7A and 7B, for example. Should the ladder 36 be against the building, arm member 42 is not needed. Further, arm member 42 may be provided in holder 44 of apparatus 10 attached to ladder 36 when the ladder is first being set up by a user prior to placement against a structure. Thus, apparatus 10 when attached to ladder 36 supports the ladder on a single sole supporting leg 12, via foot 22, such that the bottom end of ladder 36 (e.g., bottom of ladder leg(s) 39 closest to surface 52 in FIG. 4) is set at an elevated position or height above a surface, such as shown for example in FIGS. 4-6, 7A-C, and a user can extend or lower the ladder's upper portion by himself or herself without ladder spinning and possibly causing a dangerous situation by the user losing control over the ladder. Ladder 36 with apparatus 10, attached via only rungs 40*a* and 40*b*, may be moved from surface 52 without any modification (e.g., height adjustment) to another surface. Without need to adjust height, leg 12 consequently is non-adjustable in its length as shown in FIGS. 1-3.

The apparatus 10 may be provided in a kit with or without arm member 42.

From the foregoing description, it will be apparent that an apparatus, attachment, and method of using such apparatus, providing a single support to an extension ladder enabling the ladder to be use on level and non-level surfaces has been provided. Variations and modifications of the herein described apparatus, attachment, and method for implementing the invention will undoubtedly suggest themselves, to those skilled in the art. For example, other dimensions of components described herein may be used. Accordingly the foregoing description should be taken as illustrative and not in a limiting sense.

The invention claimed is:

1. An apparatus configured to attach to an extension ladder, said extension ladder having two elongated parallel sides and rungs extending between said sides, and said extension ladder having a lower portion and an upper portion movable with respect to said lower portion to raise or lower a top end of the extension ladder, said apparatus comprising:

a single leg having members configured to latch the leg onto a plurality of adjacent rungs of said rungs of said ladder by each of said members being configured to engage, between said sides of said ladder, onto an exterior of first and second rungs of said plurality of adjacent rungs, wherein the leg has a major length configured to extend parallel to a major length of the sides of said ladder;

a first of said members is non-adjustably fixed in position relative to said leg, and said first of said members has a channel, and said first of said members is configured to receive said first rung engaged with said first of said members along a major length of said channel, in which said major length of said channel extends perpendicular to said major length of said leg, a second of said members is configured to receive said second rung;

a single foot mounted to one end of said leg to pivot about an axis of rotation parallel to said major length of said channel, in which said foot is configured to support said leg upon a level or non-level surface such that said leg solely supports a bottom end of said ladder, via said foot, in an elevated position above said level or non-level surface with said leg latched by said members to said ladder, wherein said first of said members is a closest one of said members to said foot, and said major length of said leg is non-adjustable;

a single shaft removeably attached to said leg between said foot and said closest one of said members to said foot, in which a major length of said shaft is configured to extend away from said major length of said leg and a major plane of said ladder to allow a user to stabilize said leg above the level or non-level surface so that said shaft prevents uncontrolled spinning of the ladder during raising or lowering movement of said upper portion of the ladder with respect to said lower portion of the ladder when said shaft is attached to said leg and said leg is latched to said ladder and said foot supports said leg upon said level or non-level surface;

a step member attached to said leg between said foot and said closest one of said members to said foot, said step member configured to provide a step configured to support a user climbing or descending the ladder when said leg is latched by said members to said ladder and said foot supports said leg upon said level or non-level surface; and when the apparatus is latched to said ladder, said step member and said leg are configured to pivot together as said ladder pivots about said axis of rotation in order to horizontally orient said step as said ladder is angled and said foot supports said leg upon said level or non-level surface.

2. The apparatus according to claim 1 wherein said members for latching said leg to said ladder operate independent of said shaft.

3. The apparatus according to claim 1 wherein said shaft is movable with respect to said leg to position said shaft from being a safety hazard during ladder usage.

4. The apparatus according to claim 1 wherein said leg is configured at least approximately centered between the sides of said ladder when said members latch said leg onto said plurality of adjacent rungs of said rungs of said ladder.

5. The apparatus according to claim 1 wherein said foot has a bottom comprising a gripping surface and a pick portion, and said foot is pivotal about said axis of rotation to select one of said gripping surface or said pick portion for application to said level or non-level surface, in which selection of said pick portion positions said pick portion into a depth below said level or non-level surface, and selection of said gripping surface applies said gripping surface directly onto said level or non-level surface.

6. The apparatus according to claim 1, further comprising said step member having a major top surface, said step member configured to extend away from said leg at a first angle so that pivoting said leg backwards relative to said axis of rotation pivots said step member upwards relative to said level or non-level surface to enable the major top surface of said step member to be horizontal, said major top surface configured to be horizontal when the major length of said ladder and the major length of said leg are substantially angled with respect to horizontal.

7. The apparatus according to claim 1, further comprising a holder attached to said leg, wherein said shaft is removably attached to said leg by said holder.

8. The apparatus according to claim 1 wherein said channel is configured to extend at least half of a distance between said sides of the ladder when said members latch said leg onto said plurality of adjacent rungs of said rungs of said ladder.

9. A system configured to elevate an extension ladder, said extension ladder having two elongated parallel sides and rungs extending between said sides, said system comprising:

a single leg having rung engaging members configured to secure the leg onto a plurality of adjacent rungs of said rungs of said ladder by each of said members being configured to engage, between said sides of said ladder, onto an exterior of first and second rungs of said plurality of adjacent rungs, the first rung being a bottom-most rung of said rungs, wherein the leg has a major length configured to extend parallel to a major length of the sides of said ladder;

a first of said members is non-adjustably fixed in position relative to said leg, and said first of said members has a channel, and said first of said members is configured to receive said first rung engaged with said first of said members along a major length of said channel, in which said major length of said channel extends perpendicular to said major length of said leg, a second of said members is configured to receive said second rung;

a single foot mounted to one end of said leg to pivot about an axis of rotation parallel to said major length of said channel, in which said foot is configured to support said leg upon a level or non-level surface such that said leg solely supports a bottom end of said ladder, via said foot, in an elevated position above said level or non-level surface with said leg latched by said members to said ladder, wherein said first of said members is a closest one of said members to said foot, and said major length of said leg is non-adjustable;

a first non-rung engaging member consisting of a single shaft removeably attached to said leg between said foot and said closest one of said members to said foot, in which a major length of said shaft is configured to extend away from said major length of said leg and a major plane of said ladder to allow a user to stabilize said leg above the level or non-level surface so that said shaft prevents uncontrolled spinning of the ladder during raising or lowering movement of an upper portion of the ladder with respect to a lower portion of the ladder when said shaft is attached to said leg and said leg is latched to said ladder and said foot supports said leg upon said level or non-level surface;

a second non-rung engaging member consisting of a step member attached to said leg between said foot and said closest one of said members to said foot, said step member configured to provide a step configured to support a user climbing or descending the ladder when said leg is latched by said members to said ladder and said foot supports said leg upon said level or non-level surface; and when the leg is latched to said ladder, said step member and said leg are configured to pivot together as said ladder pivots about said axis of rotation in order to horizontally orient said step as said ladder is angled and said foot supports said leg upon said level or non-level surface.

* * * * *